United States Patent [19]

Liu

[11] Patent Number: 4,941,215

[45] Date of Patent: Jul. 17, 1990

[54] AUTOMATIC FLUSHING DEVICE FOR A FLUSH TOILET

[76] Inventor: Su-Haw Liu, 41-2, Lane 24, Shin Kang Rd., Lin-Ya Dist., Kaosiung, Taiwan

[21] Appl. No.: 299,037

[22] Filed: Jan. 19, 1989

[51] Int. Cl.[5] ..... E03D 5/10

[52] U.S. Cl. ..... 4/406; 4/DIG. 3

[58] Field of Search ..... 4/406, DIG. 3

[56] References Cited

U.S. PATENT DOCUMENTS

| | | | |
|---|---|---|---|
| 939,123 | 11/1909 | Christy | 4/406 X |
| 1,626,255 | 4/1927 | Roth | 4/406 |
| 2,056,087 | 9/1936 | Andrews | 4/406 |
| 3,090,967 | 5/1963 | Erhardt et al. | 4/406 X |
| 3,334,359 | 8/1967 | Weingartner | 4/406 X |
| 3,541,614 | 11/1970 | Zorn | 4/406 X |
| 4,141,091 | 2/1979 | Pulvari | 4/DIG. 3 X |
| 4,380,835 | 4/1983 | Yao | 4/406 |
| 4,793,588 | 12/1988 | Laverty, Jr. | 251/30.03 |

*Primary Examiner*—Henry J. Recla
*Assistant Examiner*—R. M. Fetsuga
*Attorney, Agent, or Firm*—Larson and Taylor

[57] ABSTRACT

An automatic flushing device for a flush toilet comprising an infrared sensor which can sense when the toilet has been used and then give out a signal to command the water in the tank to be flushed out for a pre-set period of time automatically. The infrared sensor is implanted in a cap covering recess centered in the tank lid which houses an electric coil.

2 Claims, 4 Drawing Sheets

AUTOMATIC FLUSHING DEVICE FOR A FLUSH TOILET

BACKGROUND OF THE INVENTION

Conventional flush toilets generally require pushing of the flush handle manually for flushing away waste each time they are used. Should it be neglected to be flushed, the next person may feel very uncomfortable using it.

SUMMARY OF THE INVENTION

In order to solve the problems mentioned above, this invention has been devised to equip a flush toilet with an automatic flushing device without need for manual actuation.

This automatic flushing device for a flush toilet in accordance with the present invention comprises an infrared sensor to sense if the flush toilet has been used to give out a signal to electrify a coil fixed in a central round recess in the tank lid for a pre-set period of time so as to pull up a rod combined with a rhomboidal ball to open a valve seat to flush the water in the tank to the bowl.

The rod is provided extending vertically in the tank and through the internal empty space of the coil to be pulled up by the coil while the coil is electrified.

The round recess in the tank lid is covered by a cap having a downward protruding round wall to engage by means of male and female threads with the circumspherical inner face of the round recess.

A coil spring is provided inside the coil and positioned on a disc horizontally fixed on the rod and also positioned inside the coil under the cap.

The rod has its upper end extending up through the recess cap and combines with a nut and its lower end combined with a rhomboidal ball which ordinarily blocks up the valve seat and opens it when the rod is pulled up, controlling the flush of the water in the tank. In addition, the rod is kept at its place at its middle by means of a positioning hole in a horizontal arm so as to move up and down without declining to any side.

After the rod has been pulled up by the magnetization of the coil for a pre-set period of time and the electricity stops, the rod is to be pushed down by the spring compressed by the disc and the rhomboidal ball is to block up the valve seat.

BRIEF DESCRIPTION OF THE DRAWINGS

This invention will now be described in detail with reference to accompanying drawings wherein.

DETAILED DESCRIPTION OF THE INVENTION

Figure 1:
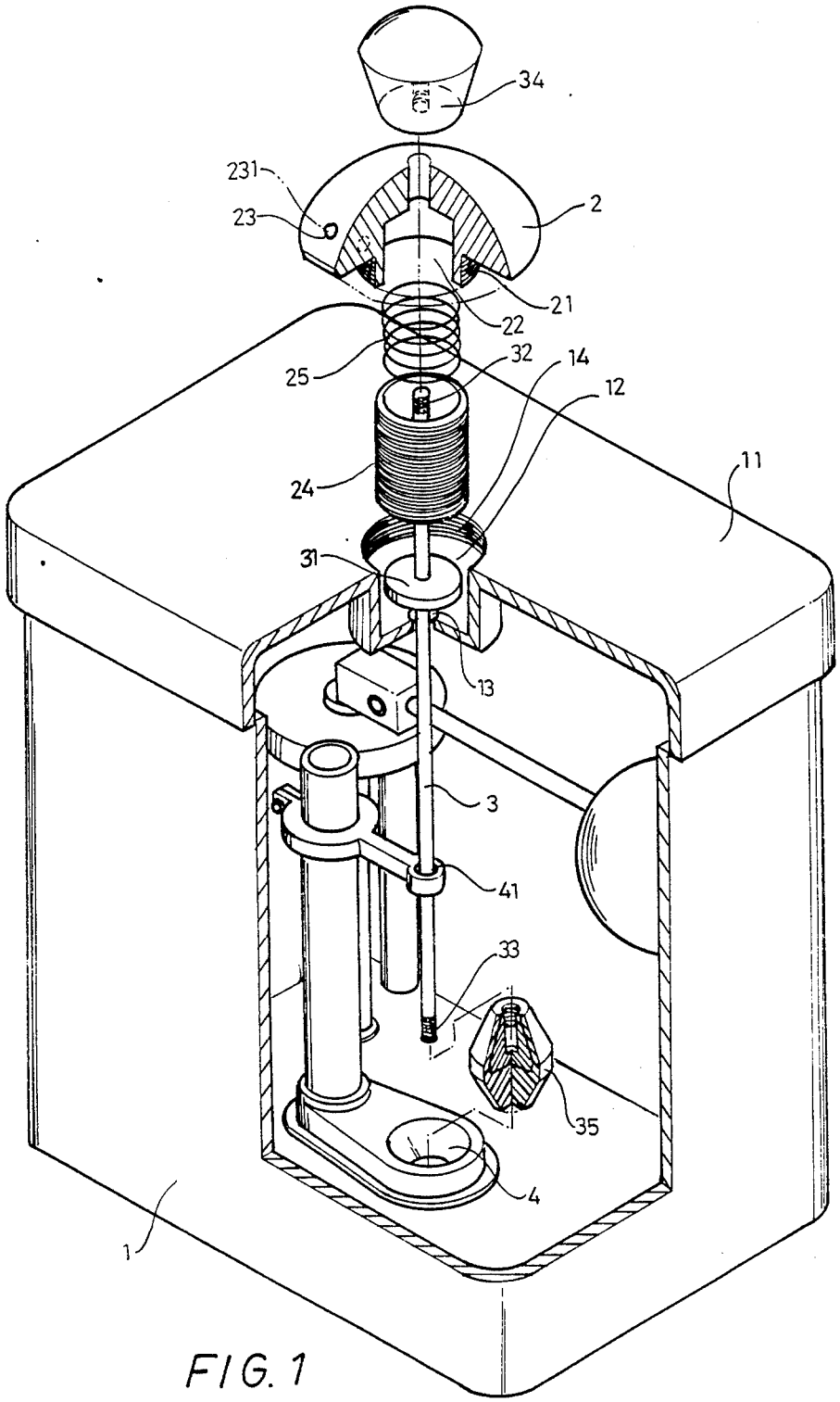
FIG. 1 is an exploded view of the automatic flushing device for a flush toilet in accordance with the present invention.

At first, as shown in FIG. 1, a tank 1 combined with this automatic flushing device has the same construction as a conventional tank for filling water and a float in controlling the level of the water in the tank. Thus, it is not described further, while the automatic flushing device in accordance with the present invention is to be described as follows.

The automatic flushing device comprises a rod 3 vertically set in the tank 1 extending up through a round recess 12 set in the middle of a tank lid 11 and also through a round hole 13 in the bottom of the recess 12. The vertical inside wall of the recess 12 is provided with female threads 14 for male threads 21 on the round protruding-downward wall of a cap 12 covering the round recess 12 to engage with.

The cap 2 is provided with a round wall protruding downward and cut with male threads 21 for engaging with the female threads 14, two small holes 23 in the upper section for implanting an infrared sensor 231, and an opening 22 for the rod 3 to pass through and for a coil 24 to be set therein. In addition, a disc 31 is welded vertically with the rod 3 at the opening bottom. A coil spring 25 is placed in the empty interior space of the coil 24 and restricted between the disc 31 and the cap 2.

The rod 3 is provided with male threads 32, 33 at the upper and the lower ends; the upper end with the male threads 32 passing through the cap 2 combines with a nut 34; the lower end with the male threads 33 combines with a rhomboidal ball 35, which ordinarily blocks up the valve seat 4 (i.e. a water outlet) to stop the flushing down of the water to the bowl. In addition, the rod 3 has the disc 31 vertically welded thereto in the recess 12, and can only move up and down as it is held in a positioning round hole 41 in a horizontal arm.

Figure 2:
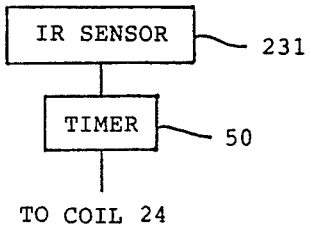
FIG. 2 is a diagram of the control circuit for the automatic flushing device for a flush toilet in accordance with the present invention.
Figure 3:
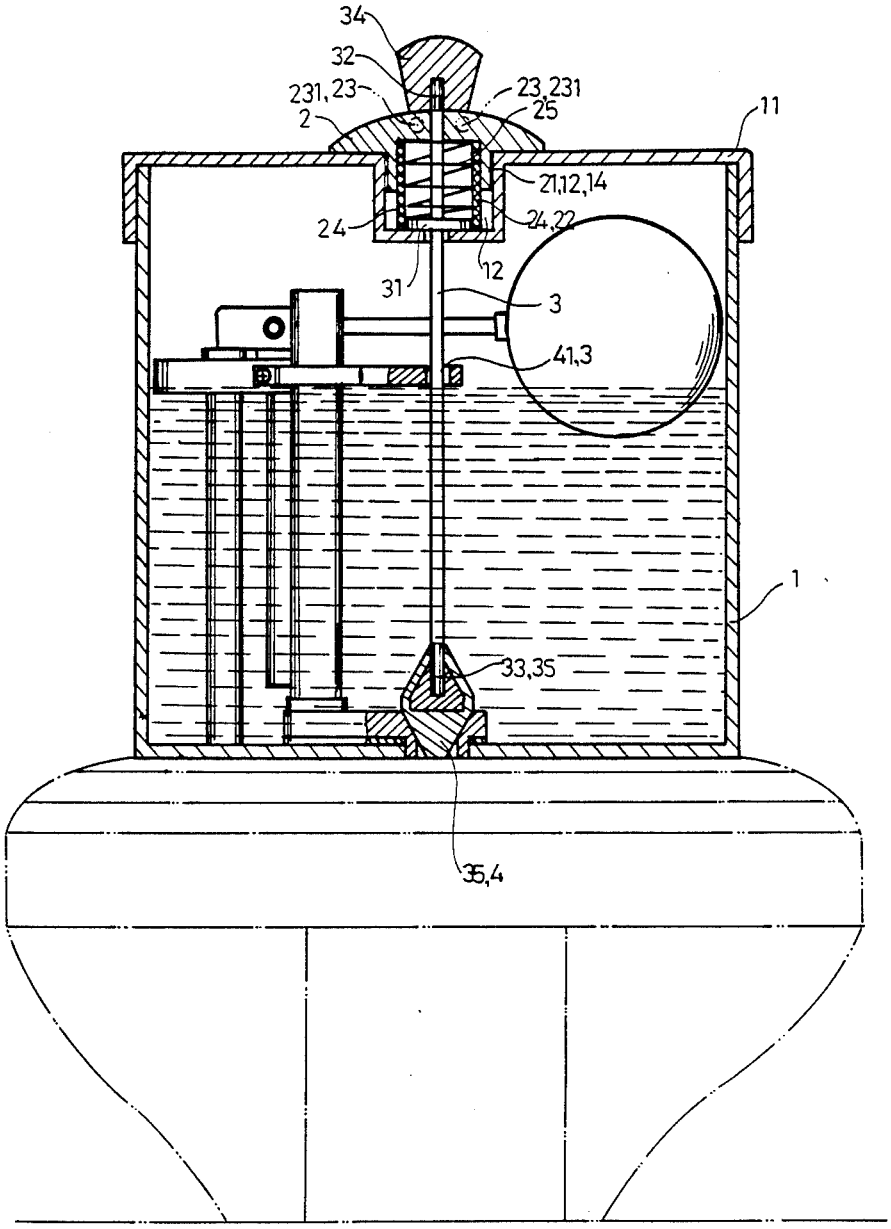
FIG. 3 is a front view of the automatic flushing device combined with a flush toilet in accordance with the present invention.
Figure 4:
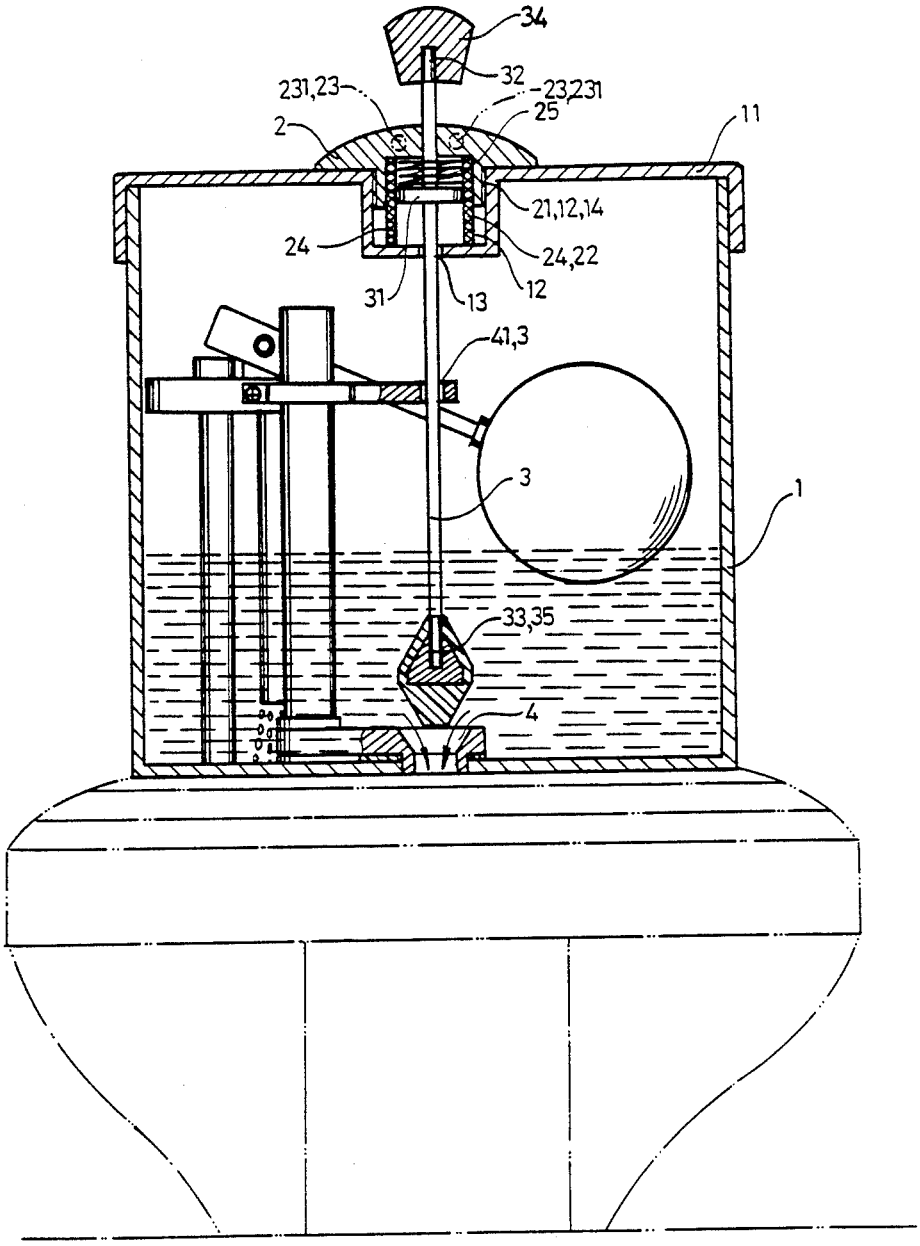
FIG. 4 is an operational view of the automatic flushing device combined with a flush toilet in accordance with the present invention.

FIGS. 2, 3 and 4 show that the vertical movement of the rod 3 is controlled by the magnetization of the coil 24. Actuation of coil 24 for a pre-set period of time is caused by a timer 50 which is started by a signal coming from the infrared sensor 231 implanted in the small round holes 23 in the cap 2. The infrared sensor 231 can sense if the toilet has been used and sends a signal after a proper time so as to electrify the coil 24. Then the empty space inside the coil can become magnetized and the disc 31 provided on the upper section of the rod 3 is just positioned in the center of the magnetized field such that the disc 31 and hence the rod 3 can be pulled upward. Consequently, the rhomboidal ball 35 at the lower end of the rod 3 which ordinarily shuts up the valve seat 4 is also pulled up to flush the water in the tank to the bowl. After the pre-set period of time passes, the coil 24 stops generating a magnetic field. When this occurs, rod 3 is pushed down by the spring 25 pushing the disc 31 down, and consequently the rhomboidal ball 35 goes down to block up the valve seat 4. Then the float sinks down with the water level, functioning to fill water in the tank.

What is claimed is:

1. An automatic flushing device for a flush toilet having a tank filled with water, the flush toilet being provided with a valve seat and sealing ball to allow draining of the tank to flush the toilet, said flushing device comprising:

a tank lid for a top of the tank, said tank lid including a recess therein;

a rod which is mounted for vertical movement in the tank, said rod being attached at one end to the sealing ball and extending upwards therefrom and through said recess;

a horizontal disc attached to said rod and located in said recess;

a coil located in said recess about said disc;

a cap which covers said recess;

a coil spring located between said cap and said disc which urges said disc toward the valve seat;

a nut provided on top of said cap which is secured to the other end of said rod; and a control means, including an infrared sensor located above and adjacent said tank lid, for sensing the use of the toilet by a user and for causing energization of said coil after the user leaves for a predetermined period of time, the energizing of said coil causing said disc to be raised and hence said rod to pull said ball from the valve seat so that the toilet is flushed and such that after the predetermined period of time the coil is deenergized so that said coil spring urges said disc and hence said rod downwardly whereby the ball is returned to the valve seat.

2. An automatic flushing device as claimed in claim 1 wherein said cap includes two holes therein, and wherein said infrared sensor means is received in said holes.

* * * * *